United States Patent [19]

Tatsuta et al.

[11] 4,120,724

[45] Oct. 17, 1978

[54] SUBBING MATERIAL FOR STYRENE BASES USED IN PHOTOGRAPHIC ELEMENTS

[75] Inventors: Sumitaka Tatsuta; Nobuo Yamamoto; Nobuo Tsuji, all of Minami-ashigara, Japan

[73] Assignee: Fuji Photo Film Co., Ltd., Minami-ashigara, Japan

[21] Appl. No.: 770,147

[22] Filed: Feb. 18, 1977

Related U.S. Application Data

[63] Continuation of Ser. No. 561,505, Mar. 24, 1975, abandoned, which is a continuation-in-part of Ser. No. 402,692, Oct. 2, 1973, abandoned.

[30] Foreign Application Priority Data

Oct. 2, 1972 [JP] Japan ..... 47-98821

[51] Int. Cl.[2] ..... G03C 1/78

[52] U.S. Cl. ..... 96/87 A; 96/29 R; 96/87 R; 427/40; 427/407 C

[58] Field of Search ..... 427/40, 407; 96/87 R, 96/29 R, 87 A

[56] References Cited

U.S. PATENT DOCUMENTS

| | | | |
|---|---|---|---|
| 2,306,071 | 12/1942 | McNally et al. | 260/78 |
| 3,007,901 | 11/1961 | Minsk | 260/78.3 |
| 3,232,756 | 2/1966 | Yakel et al. | 96/87 R |
| 3,454,424 | 7/1969 | Schneider | 96/87 R |
| 3,492,122 | 1/1970 | Takenaka et al. | 96/87 R |
| 3,527,605 | 9/1970 | Fisch et al. | 96/87 R |
| 3,645,740 | 2/1972 | Nishio et al. | 96/87 R |
| 3,679,455 | 7/1972 | Kasugai et al. | 96/87 R |
| 3,770,443 | 11/1973 | Osuda et al. | 96/87 R |
| 3,811,913 | 5/1974 | Kasugai et al. | 96/87 R |
| 3,867,167 | 2/1975 | Tatauto et al. | 96/87 R |

*Primary Examiner*—Jack P. Brammer

*Attorney, Agent, or Firm*—Sughrue, Rothwell, Mion, Zinn and Macpeak

[57] ABSTRACT

A photographic material comprising (I) a styrene-based polymer support having thereon a subbing layer which comprises a partial or complete reaction product of (a) a copolymer of styrene or vinyl acetate with maleic anhydride with (b) water or a hydroxy compound such as alcohol and (II) a photographic layer comprising a hydrophilic resin binder bearing on the subbing layer, wherein a compound containing two or more epoxy groups per molecule is contained in the subbing layer or in both of the subbing layer and the photographic layer.

20 Claims, No Drawings

SUBBING MATERIAL FOR STYRENE BASES USED IN PHOTOGRAPHIC ELEMENTS

CROSS-REFERENCE TO RELATED APPLICATION

This application is a continuation application of Ser. No. 561,505, filed Mar. 24, 1975 now abandoned, in turn a Continuation-In-Part of U.S. Application Ser. No. 402,692 filed Oct. 2, 1973, in the name of Sumitaka Tatsuta et al, entitled "Photographic Material", now

BACKGROUND OF THE INVENTION

1. Field of the Invention

This invention relates to a photographic material comprising a film support of a polymer comprising substantially a polymer of styrene and having thereon a subbing layer which has strong adhesivity to a photographic layer comprising a hydrophilic resin binder, such as light-sensitive layers or image-receiving layers as are used in conventional photography.

2. Description of the Prior Art

Generally a polymeric film consisting mainly of styrene is a desirable material for a photographic support because of its excellent transparency, physical strength, dimensional stability and strength. However, such a support has a very hydrophobic surface, as is apparent from the molecular structure, so some pretreatment such as undercoating is necessary to provide a photographic layer consisting of a hydrophilic resin binder on the support with strong adhesion such that the photographic layer does not separate from the support during processing and using.

As a method of undercoating a photographic support consisting substantially of a styrene polymer, it is known to use homopolymers or copolymers of acrylic acid esters, methacrylic acid esters, acrylic acid, methacrylic acid and acrylamide, or copolymers thereof with styrene.

However, a one layer coating of the above-mentioned (co)polymers on the support is insufficient to obtain effective results and, therefore, complicated multi-layer undercoating has been carried out in practice. For example, undercoating using a three layer structure is most commonly conducted wherein a polymer layer of the above-mentioned acrylic type is provided as a first layer, a nitrocellulose layer is used as a second layer and further a dispersion of gelatin in an organic solvent is employed as a third layer. Such multi-layer undercoating is most undesirable because of the required complicated processing, the increase in the production cost and the deterioration in the stability of a product. Furthermore, this method is dangerous because it is necessary to use a very flammable nitrocellulose resin.

U.S. Pat. No. 3,072,482 Beeber et al discloses vinyl methyl ether-maleic anhydride polymer used in a small amount in a subbing layer as a supplementary component of the subbing layer where a gelatin subbing solution (cf. Col. 2) is necessary.

U.S. Pat. No. 3,645,740 Nishio et al and U.S. Pat. No. 3,770,443 Osada et al disclose photographic elements which contain epoxy compounds useful in the present invention.

U.S. Pat. No. 3,527,605 Fisch et al discloses epoxidized materials useful in a subbing layer.

As a result of research on suitable undercoating materials for the purpose of overcoming the above-described disadvantages, it has been found that a complete or partial reaction product of a copolymer of styrene or vinyl acetate with maleic anhydride with water or a hydroxy compound represented by the general formula $R_1$—OH, wherein $R_1$ is a monovalent hydrocarbon group having 1 to 12 carbon atoms or monovalent organic group having 2 to 12 carbon atoms and consisting of at least two hydrocarbon fragments and at least one ether linkage between said hydrocarbon fragments ($R_1$ does not represent cyclic ether linkage), preferably an alkyl group, is very effective for the adhesion of a hydrophilic photographic layer to a support of a polymer consisting predeominantly of styrene. The above-described copolymer has in its polymeric structure, at least partially, recurring units having the formula:

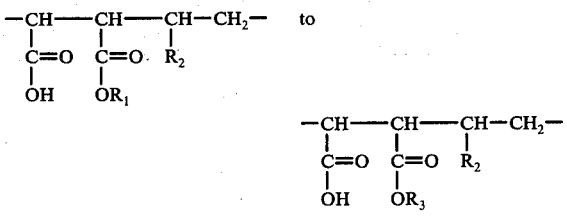

in which $R_3$ is a hydrogen atom or a group described above for $R_1$ and $R_2$ is a phenyl group (when the copolymer is a styrene copolymer) or a —$OCOCH_3$ group (when the copolymer is a vinyl acetate copolymer).

When a support of a polymer consisting mainly of styrene is undercoated with the above-described copolymer, the adhesiveness of a hydrophilic photographic layer to this support is markedly increased, but the undercoated layer must be quite thick. i.e., a thickness of more than several microns. Accordingly, coating and surface difficulties often take place. Furthermore, the adhesive strength is not quite as sufficient as desired, in particular, when wetted in a strongly alkaline developer.

SUMMARY OF THE INVENTION

We have now surprisingly found, as a result of our studies to overcome the above-described two disadvantages, an undercoating material capable of imparting an excellent adhesive strength and yet a very thin layer, both at the time of drying as well as on wetting, by the joint use, with the above-mentioned copolymer, of an epoxy compound.

That is to say, in accordance with the present invention, a photographic material is provided having an undercoating layer containing a complete or partial reaction product of a copolymer of styrene or vinyl acetate and maleic anhydride with water or a hydroxy compound represented by the general formula $R_1$—OH, wherein $R_1$ is a hydrogen when the compound is water, a monovalent hydrocarbon group having 1 to 12 carbon atoms or monovalent organic group having 2 to 12 carbon atoms and consisting of at least two hydrocarbon fragments and at least one ether linkage between said hydrocarbon fragments ($R_1$ does not represent cyclic ether linkage) when the compound is a hydroxy compound, and a compound containing two or more epoxy groups per molecule on a support member of a polymer consisting predominantly of styrene.

At least 30 mol %, and preferably more than 60 mol %, of the units of maleic anhydride in the copolymer should react with the hydroxy compound or with water.

The percentage of maleic anhydride in the copolymer is from 40 to 50% by weight, preferably about 50% by weight, based on copolymer weight.

DETAILED DESCRIPTION OF THE INVENTION

As the monovalent hydrocarbon group there are an alkyl group, a phenyl group, and a phenylalkyl group, and as the monovalent organic group which contains at least one ether linkage in the group there are an alkoxyalkyl group, an alkoxyalkoxyalkyl group and a phenoxyalkyl group.

As described above, water or a hydroxy compound of the formula $R_1$—OH such as methanol, ethanol, propanol, isopropanol, butanol, sec-butanol, amylalcohol, sec-amylalcohol, isoamylalcohol, 2-ethylhexylalcohol, octanol, nonanol, decanol, t-octanol, dodecanol, phenoxyethanol, methoxyethanol, butoxyethanol, acetoxyethanol, β-methoxyethoxyethanol, phenylpropanol, and the like, is employed in preparing the copolymer used in this invention. Mixtures of such hydroxy compounds can be used, if desired.

A suppert member having the undercoating layer according to the present invention favorably compares to one having an undercoating layer consisting only of the above-described copolymer with respect to the adhesiveness to a hydrophilic photographic layer.

As the epoxy compound of the invention, any polyfunctional epoxy compound having at least two epoxy groups in the molecula can be used. The epoxy compound will generally have a molecular weight less than about 20,000 preferably less than 1,000. Typical of such epoxy compounds are the following compounds:

Typical Epoxy Compounds

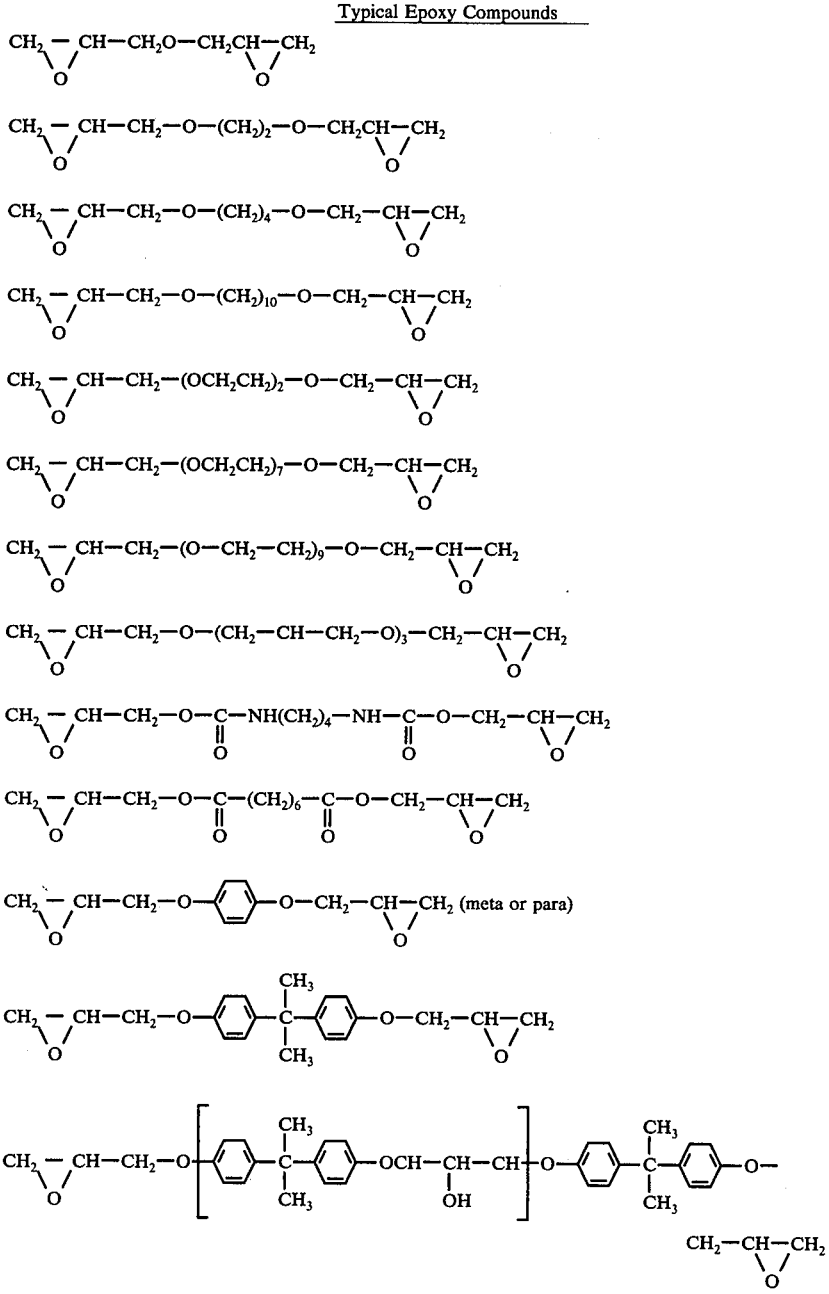

(1)

(2)

(3)

(4)

(5)

(6)

(7)

(8)

(9)

(10)

(11)

(12)

(13)

-continued
Typical Epoxy Compounds
(14)
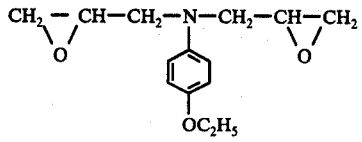
(15)
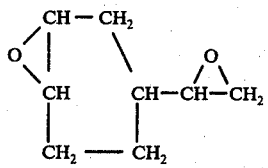
(16)
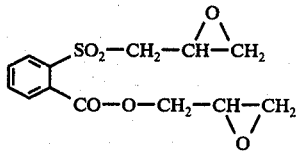
(17)
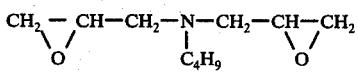
(18)
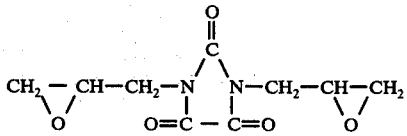
(19)
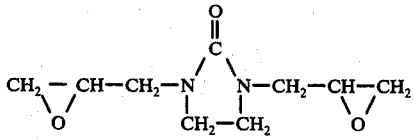
(20)
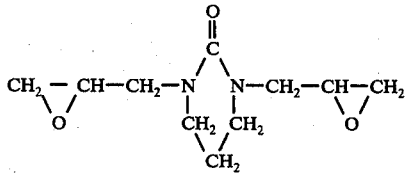
(21)
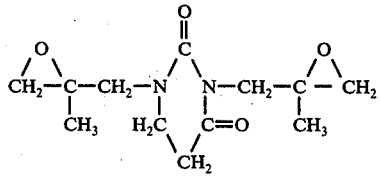
(22)
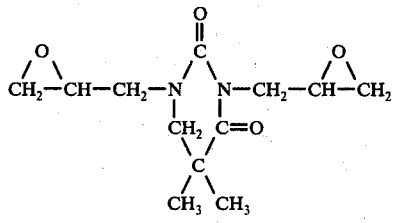
-continued
Typical Epoxy Compounds
(23)
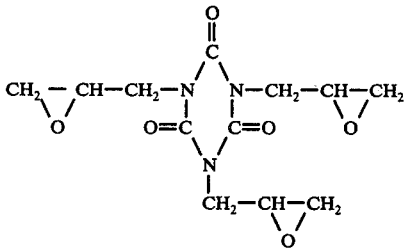
(24)
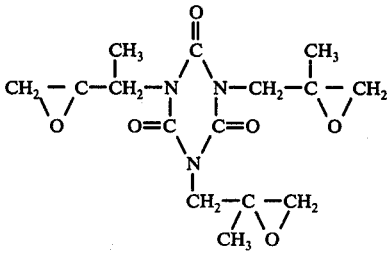
(25)
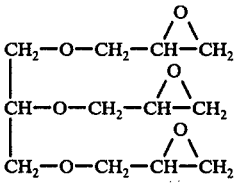
(26)
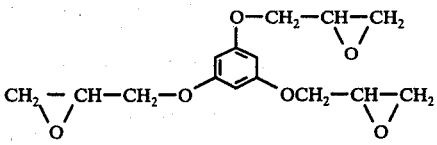
(27)
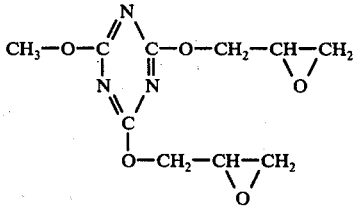
(28)
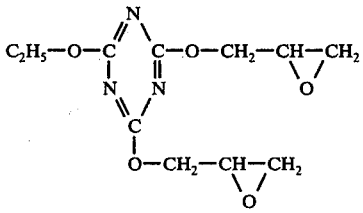
(29)
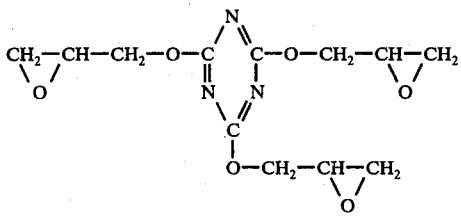

-continued

Typical Epoxy Compounds (30)

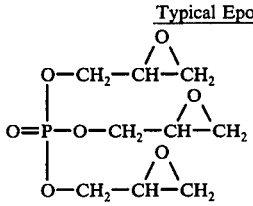

(31)

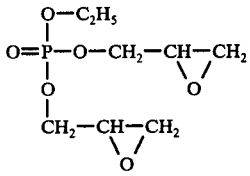

(32)

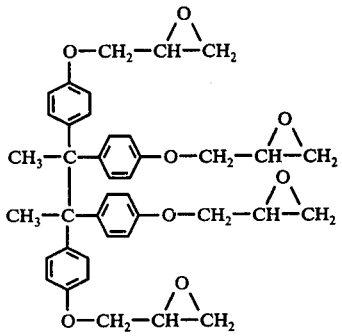

(33) a polymer of glycidyl acrylate or glycidyl methacrylate, or a copolymer thereof with polymerizable ethylenically unsaturated compounds such as glicidil acrylate, glycidyl methacrylate, ethylene, styrene, vinyl chloride, vinylidene chloride, acrylic acid, an acrylic ester, methacrylic acid, a methacrylic ester, acrylonitrile and an acrylic amide.

(34) a polymer of compound 12 (usually a polymer having a molecular weight lower than 1,000 is used).

It shall be specifically understood that the exact epoxy compound used is not critical so long as it is polyfunctional and contains at least two epoxy groups.

These epoxy compounds can be prepared using known methods, for example, by treating a compound having an active hydrogen containing group, such as a hydroxyl, carboxyl, amino, imino or amide group with a halohydrin, such as epichlorohydrin, epibromohydrin, methyl-epichlorohydrin, or methyl-epibromohydrin, by treating a compound containing an active halogen such as the acid halides, for example, the sulfonic acid halides, with glycidol, or by subjecting an ethylenically unsaturated compound to an oxidation treatment. These polyfunctional epoxy compounds used in the present invention and their preparation are disclosed in "Epoxy Resins Their Application and Technology", McGraw Hill Book Co., Inc., New York (1957), pages 15–21, "Epoxy Resin Technology", Interscience Publishers, New York (1968), pages 2–14, U.S. Pat. No. 3,562,275, U.S. Pat. No. 3,620,983 and Swiss Pat. No. 471,811. Some of these compounds are commercially available, for example, as Aralidite-6005 and Arlidite-6010 from Ciba Co., Inc. and as Epon-820 and Epon-828 from Shell Chemical Co. Epoxy compounds (3), (6), (7), (12) and (23) are particularly preferred.

Mixtures of such epoxy compounds can be used, if desired.

The above-described epoxy compound used in the invention is mixed with the copolymer containing maleic acid ester units and the resulting mixture is coated onto a support of a polymer consisting predominantly of styrene, followed by a further coating of a hydrophilic photographic layer.

It is not completely clear why the undercoated layer according to the invention strengthens the adhesion between the support and the hydrophilic photographic layer. However, the wetting adhesive strength in various photographic processing baths is markedly increased by the practice of the invention. This is possibly due to the formation of an insoluble network structure by the self bridging reaction of the polyfunctional epoxy compound in the undercoated layer end by the bridging reaction of the polyfunctional epoxy compound with the maleic acid ester unit-containing copolymer having a number of carboxyl groups as side chains serves to suppress stripping and breaking of the support/undercoated layer/hydrophilic photographic layer at the layer boundary and to prevent the undercoated layer from dissolving out. Moreover, it is assumed that a polyfunctional epoxy compound used in the invention and its self bridging product fulfill a plasticizing effect on the maleic acid ester unit-containing copolymer, suppress generation of internal stresses in the undercoated layer containing the copolymer and thus prevent the aggregation and breakage thereof. This effect not only provides the ability to use a much thinner undercoating than can be used when the undercoated layer consists only of the copolymer but also increase the adhesive strength at the time of drying.

The present invention will now be illustrated in greater detail.

In the present invention, the term "support composed of a styrene-base polymer" is used herein to mean a support which is fabricated into a film from a homopolymer of styrene, a homopolymer of a substituted styrene which is exemplified by α-methyl styrene, chlorostyrene, vinyl toluene and the like, or copolymers of styrene with a copolymerizable comonomer such as ethylene, butadiene, isoprene, vinyl chloride, vinylidene chloride, vinyl acetate, vinyl propionate, acrylic or methacrylic acid esters (for example, the methyl, ethyl, butyl, ethylhexyl, methoxyethyl cyclohexyl, lauryl ester, etc.), acrylic acid or methacrylic acid amides (for example, acrylamide, methacrylamide, diacetone acrylamide), vinyl methyl ether, vinyl butyl ether, vinyl chloroethyl ether, etc., or mixtures of such materials, which are exemplified by a styrene/butadiene copolymer, a styrene/acrylonitrile copolymer, etc. The styrene content in the polymer or copolymer can range from about 10 to 100 wt.%, based on the weight of the polymers in the support. Basically any of these materials which will form a film can be employed and accordingly the molecular weights are not limiting. Generally, molecular weights ranging from about 5,000 to about 2,000,000, preferably 80,000 to about 500,000, are employed from a practical standpoint. Hereinafter, the term "support" means a support composed of the styrene-base polymer as described above, unless otherwise indicated.

The support can be a transparent film or can be a film having a filler, such as $TiO_2$, $CaCO_3$, $Al_2O_3$, ZnO, carbon black, etc., incorporated therein at a filler content of from about 1 to 10 wt.%, preferably 2 to 4 wt.% based on the weight of the polymer(s). Additives such as dyes, fluorescent whitening agents, antistatic agents, etc., can be incorporated in the support in conventional amounts. The surfaces of the support can be roughened as in a synthetic paper, as described, for example, in U.S. Pat. No. 3,723,159. The presence or absence of these additives or modifiers gives rise to no adverse influences on the effects of the present invention since the support is mainly composed of styrene.

The surface of the suport described above adheres extremely strongly to a photographic layer comprising a hydrophilic resin binder. The term thus photographic layer comprising a hydrophilic resin binder" includes a hydrophilic colloid layer containing silver halide, silver iodobromide, silver iodochloride, silver chloride, silver chlorobromide, silver bromide, etc., as in a black and white film, a color film or a printing paper, a hydrophilic colloid layer containing physical developing nuclei such as silver sulfide, as in a receiving layer used in diffusion transfer photography, a photographically conventional backing layer which is coated on the back of the support for the purpose of curl preventing, antihalation, etc., and so on. The hydrophilic resin which is most commonly used as a photographic layer is gelatin and other examples are graft-gelatin, acylated gelatin, etc., and natrual or synthetic hydrophilic resins which are exemplified by casein, agarose, polyvinyl alcohol, polyvinyl pyrrolidone, vinyl pyrrolidone and a vinyl alcohol copolymer with another monomer such as acrylic acid, methacrylic acid, or the amide or ester thereof such as the methyl, ethyl, hydroxypropyl, methoxyethyl, hydroxyethyl, ethoxybutyl esters, vinyl merthyl ether, vinyl propionate, styrene maleic anhydride, and the like, etc. The support subbed with the material in accordance with the present invention can adhere extremely strongly to photographic layers comprising any of the hydrophilic resins described above. The adhesion thus obtained does not deteriorate after the passage of time both for a film prior to exposure, i.e., as initially prepared, and after development processing.

The undercoating method according to the present invention consists in preparing a solution of the foregoing copolymer and epoxy compound in water or an organic solvent, applying the solution to a support and drying. Illustrative solvents for the foregoing copolymer are alcohols such as methanol, ethanol and propanol, ketones such as acetone and methyl ethyl ketone, and halogenated hydrocarbons such as methylene chloride and trichlene. The epoxy compound is soluble in acetone, dimethylformamide and methanol, and mixtures with other solvents.

In the photographic material of the invention, the undercoating can be carried out using any solvent, but, in general, alcohols being a non-solvent for the support, in particular, methanol, are preferably used as a solvent, since ketones and halogenated hydrocarbons swell or dissolve the support consisting predominantly of styrene. The support is very stable toward alcohols and methanol is less expensive than other solvents. Of course, a suitable amount, for example, less than 50% by weight based on the weight of non-solvent of the support of another solvent (ketones such as acetone, metbylethyl ketone, methylisobutyl ketone, etc., halogenated hydrocarbons such as trichloromethylene, dichloroethylene, methylene dichloride, etc.) can be used if desired.

The amounts of the copolymer and epoxy compound used are not particularly limited, but the former is preferably used in an amount of 0.01 to 5 g or less, preferably 0.1 to 2 g, per 1 $m^2$ of the support, while the latter is generally used in a proportion of 10 to 500, preferably 50 to 200, percent by weight based on the weight of the copolymer used. The copolymer generally has a molecular weight ranging from about 8,000 to about 1,000,000 with an intrinsic viscosity [$\eta$] of about 0.05 to about 1.0 measured in methyl alcohol at 30° C.

In the undercoating of the invention, only a mixture of the foregoing copolymer and epoxy compound need be coated onto a support, but the joint use of gelatin therewith provides better results. Where gelatin is used, up to about 300 wt.%, preferably about 50 to 150 wt.%, gelatin to the copolymer can be employed. For example, when the above-described copolymer and epoxy compound are dissolved in an organic solvent in a conventional manner followed by a dispersion of gelatin therein and the resulting solution is used as an undercoating solution, a very fine surface and excellent adhesion can be obtained. Another method comprises applying only the mixed solution of the copolymer and the epoxy compound to a support, drying and then applying a dispersion of gelatin in an organic solvent. In a further embodiment of the invention, an undercoated layer of the copolymer is first provided on a support and then a photographic layer containing the epoxy compound is coated (see Example 6), whereby the epoxy compound is diffused into the undercoated layer. The amount of epoxy compound in the undercoated layer, which is diffused from the photographic layer, preferably is in the range disclosed above, i.e., 10 to 500, preferably, 50 to 200% by weight, based on the weight of copolymer used. The amount of diffusion depends on the thickness of the photographic layer, but usually in the photographic layer the epoxy compound is used in an amount of 20 to 1,000% based on the weight of the copolymer used. The thickness of the photographic layer containing an epoxy compound may be optionally selected, but usually it is in a range of 0.1 to 60 microns. The thickness does not effect the adhesivity in the present invention. The epoxy compound may be added into the photographic layer composition as a solution of a solvent either compatible or incompatible with water. In the latter case the epoxy compound is emulsified mechanically or by using an emulsifier. With any method, the advantages of the present invention are obtained.

The concentration of the undercoating solution is not particularly limited, but can be optionally determined depending on the coating means. In the case of an immersion coating method or a reverse roll coating method, for example, the viscosity can be adjusted with a solvent to about 1 cps, while in the case of a gravure coating method, it can be about 10 cps. This undercoating solution is very stable in any concentration. Drying of the undercoating solution after being coated can be conducted at a suitable temperature, preferably room temperature (e.g., about 20° to 30° C) to about 100° C.

With respect to drying, the prior art undercoating methods are considerably restricted regarding this point. That is, the drying must be carried out within a limited temperature range in order to obtain sufficient adhesion and, therefore, slight fluctuations of temperature often cause adhesion difficulties. Where the undercoating material according to the invention is used, on the contrary, a constant and good adhesion can always be obtained over a wide drying temperature range from room temperature to the softening temperature of the support itself, i.e., about 100° C. This difference is probably due to the fact that, with prior art undercoating, an etching solvent for the support must be used so as to obtain adhesion of the undercoated layer to the support through the anchor effect of the etching agent, while in the method of the invention, adhesion can be obtained due only to the chemical affinity of the undercoated layer and support without the need for any etching agents. In general, the etching power of the solvent used depends on the temperature and adhesion due to the anchor effect is greatly affected by temperature during coating or drying, while adhesion due to chemical affinity is not so affected by temperature.

The proper drying time in the present invention can be determined easily by experimentations. It depends on the solvent and the concentration of the undercoating solution. The drying time does not affect the adhesivity practically.

If the epoxy compound is contained in a photographic layer, the drying time can be determined as described above but the drying temperature should be determined carefully to prevent from deteriorating characteristics of the photographic layer by heating.

It is a great industrial advantage that the undercoating of the present invention can be achieved over a broad temperature range. In order to increase the advantages of the invention, surface activating treatments such as an electric discharge such as a corona discharge as described in U.S. Pat. Nos. 2,864,755 and 2,864,756 and electroless discharge as described in British Pat. No. 1,294,116, an ozone oxidation, an ultraviolet radiation, a flame treatment as described in U.S. Pat. No. 3,072,483, a chromate-mixed acid treatment (before coating) are very effective before or after coating of the above described undercoating solution. This activating treatment can be carried out using conventionally known techniques and apparatus. In the case of electric discharge, for example, there are methods wherein a support is exposed to DG or AG corona atmosphere produced by applying a voltage between a pair of electrodes and wherein an electric field of high frequency is generated under reduced pressure in a discharge bulb and a support is treated with molecules excited thereby, which is called "non-electrode discharge treatment." Ultraviolet irradiation can be carried out using a high voltage mercury lamp.

Some polar groups are formed on the surface of polystyrene, which is naturally hydrophobic, by these pretreatments and the surface is thus made hydrophilic. Consequently, the affinity with the polar groups in the copolymer contained in the undercoated layer is increased.

In the photographic material undercoated according to the invention, as described above, the support comprising predominantly of polystyrene adheres strongly to a photographic layer comprising the hydrophilic binder at the time of drying as well as wetting, and the thus resulting adhesion is not deteriorated by the passage of time either in the state of the film as initially prepared or after development.

In this specification, the disclosure is directed particularly to photography, but, it will be apparent to those skilled in the art that the present invention can be applied to any field where adhesion between a polymeric molding comprising predominantly polystyrene and a hydrophilic resin is involved.

The following examples are to illustrate the invention in greater detail but these examples are not to be interpreted as limiting the invention. In the examples, unless otherwise indicated, all parts and percents are by weight.

In the examples, adhesiveness tests were carried out according to the procedures described below:

1. Test method of adhesiveness of dry film

A photographic layer to be tested was notched 6 times at intervals of 5 mm, respectively, in length and width to form twenty-five squares, an adhesive tape such as a polyester tape was adhered thereto and stripped quickly at a direction of 180°. Based on the number of the stripped squares on the photographic layer, the adhesiveness was assessed using the five grades described as follows:

| Grade | Number of Stripped Squares |
|---|---|
| A | 0 - 5 |
| B | 6 - 10 |
| C | 11 - 15 |
| D | 16 - 20 |
| E | 21 - 25 |

2. Test method of adhesiveness of wet film

A film was notched using an iron pen to give a mark $x$ in each of the development solutions and rubbed strongly twenty times using finger tip. Based on the maximum width stripped along the $x$ line, the adhesive force was assessed using the five grades described as follows:

| Grade | Maximum Stripped Width |
|---|---|
| A | 0 - 0.9 m/m |
| B | 1.0 - 2.9 m/m |
| C | 3.0 - 5.0 m/m |
| D | No Resistance |
| E | Spontaneous Stripping |

In all Examples coating was carried out at room temperature (about 25° C).

EXAMPLE 1

200 g of a copolymer of maleic anhydride and styrene (molar ratio 1:1) (limiting viscosity $[\eta] = 0.615$ measured at 30° C in ethyl acetate) was added to 800 g of methanol, heated with agitation and reacted for 8 hours with refluxing (about 85° - 95° C). After the reaction, the infrared spectrum of the product showed that the absorption at 1850 $cm^{-1}$ (corresponding to the absorption of the acid anhydride C=O) disappeared. The acid number was $3.9 \times 10^{-3}$ equivalents/g. After the reaction, the polymer concentration was adjusted to 20% by weight (methanol solution).

To 5 ml of this solution were added 85 ml of methanol and 10 ml of trichloroethylene and then 1.1 g of the epoxy compound represented by Epoxy Compound (3), hereinbefore described, was added thereto to prepare an undercoating solution.

On the other hand, a biaxially stretched polystyrene support was subjected to a corona discharge treatment at a distance of 2 mm between the polystyrene support and the electrode and at a support speed of 2 m/min and a discharge output of 200 W. The thus treated support was coated at a coating rate of 5 m/min with the above-described undercoating solution using immersion coating and dried at 80° C. The undercoated polystyrene support was coated with a gelatino-silver halide color photographic emulsion having the following composition per 1 $m^2$:

| | |
|---|---|
| Silver Chlorobromide | 3.0 g |
| Gelatin | 3.5 g |
| Benzoylaceto-2-chloro-5-dodecyloxy-carbonyl anilide (yellow coupler) emulsified dispersion* | 14.0 g |
| Triethylene Phosphamide (3% acetone solution) | 3.0 ml |
| Polyvinylpyrrolidone (mol wt. approx. 360,000) | 0.7 g |

The adhesive strength between the emulsion layer and the support in the resulting photographic material ws a Grade A before, during and after development.

For comparison, a polystyrene support was subjected to a corona discharge treatment under the same conditions as described above, coated with the same undercoating solution as described above, but not containing the epoxy compound, and then coated with the same photographic emulsion. the adhesive strength of the resulting photographic material was Grade D before and after development, and Grade C during development.

For further comparison, vinly methyl ether was used instead of styrene in the aforesaid experiment, in combination with the epoxy compound. The adhesive strength of the resulting photographic material was Grade E before and after development and during development.

EXAMPLE 2

4 g of galatin was swollen in 10 g of water and then mixed with 1.4 g of salicyclic acid and 500 ml of methanol with stirring to prepare a dispersion of gelatin in methanol. To 100 ml of this dispersion were added 3.8 ml of the 20% copolymer solution of Example 1 and then 2.7 g of the epoxy compound represented by Epoxy Compound (23) to prepare an undercoating solution.

On the other hand, a biaxially stretched high impact polystyrene support containing 10% by weight of titanium dioxide was subjected to a corona discharge treatment under the same conditions as that of Example 1 and then coated with the above described undercoating solution at a coating rate of 5 m/min by immersion coating, followed by drying at room temperature. The thus undercoated support was coated with a black-and-white gelatino-silver halide photographic emulsion having the following composition per 1 $m^2$ of the support:

| | |
|---|---|
| Silver Chlorobromide | 3.5 g |
| Gelatin | 13.0 g |
| Formaldehyde (hardener) | 0.1 g |
| Saponin (wetting agent) | 0.03 g |

The adhesive strength between the emulsion layer and support of the resulting photographic material was a Grade A in both cases of a wet film during development and a dry film after development.

For comparison, the same support was undercoated with the same undercoating solution as described above but not containing the epoxy compound and then coated with the same photographic emulsion as above. The adhesive strength of the resulting photographic material was Grade C in both the dry state and the wet state.

EXAMPLE 3

In the undercoating composition of Example 2, 3 g of the eopxy compound represented by Epoxy Compound (6) was added in place of the Epoxy Compound (23) to prepare an undercoating solution. A commercially available polystyrene synthetic paper (QU-33) produced by Nihon Goseishi Co., Ltd. was coated with the undercoating solution, dried at 70° C and then coated with a coating solution for forming an image receiving layer of an image receiving material used in silver salt diffusion trnsfer photography, having the following composition per 1 $m^2$ of film:

| | |
|---|---|
| Gelatin | 3 g |
| Silver Sulfide (developing nuclei) | 0.001 g |
| Phenylmercaptotetrazole (toner) | 0.01 g |
| Saponin (wetting agent) | 0.02 g |

The adhesive strength of this image receiving material was Grade A in both the dry state and the wet state.

For comparison, a similar test was carried out on the same photographic material but using an undercoating solution which did not contain any epoxy compound. The adhesive strength was Grade B in the dry state and Grade C in the wet state.

EXAMPLE 4

200 g of a copolymer of maleic anhydride and vinyl acetate (molar ratio 1:1) (limiting viscosity $[\eta] = 0.805$, measured at 30.0° C in ethyl acetate) was added to 1000 ml of water, stirred at 80° C and after 6 hours, a substantially clear solution was obtained. Infrared analysis of the product showed that the absorption of 1850 $cm^{-1}$ substantially disappeared.

The solution was subjected to distillation under reduced pressure to remove water, dried until the water was substantially removed, and dissolved in methanol to adjust the solids content to 20% by weight (methanol solution). 5 ml of the resulting copolymer solution was diluted with 90 ml of methanol and 10 ml of trichlene and 2.6 g of the epoxy compound represented by Epoxy Compound (12) was then added thereto to prepare an undercoating solution.

On the other hand, a high impact polystyrene support was treated in an ozone atmosphere having an ozone concentration of 3 g/500 liters of air for 3 minutes, coated with the above described undercoating solution, dried at 80° C and then coated with the same silver halide photographic emulsion as that of Example 1. The adhesive strength of the emulsion and the support was Grade A in both the dry state and the wet state.

For comparison, a similar test was carried out on the same photographic material but using an undercoating solution which did not contain an epoxy compound. The adhesive strength was Grade A in the dry state but Grade E in the wet state.

EXAMPLE 5

100 g of a copolymer of maleic anhydride and styrene (molar ratio 1:1) as used in Example 1 was added to 800 g of n-hexyl alcohol, heated with agitation at 150° C, reacted for 4 hours and the reaction mixture was poured into a large amount of N-hexane to precipitate. Removing the supernatant solution, n-hexane was added thereto to extract the N-hexyl alcohol from the solid product. This procedure was repeated two or three times and, after removing the solvent, the polymeric solid was dried. The acid number was $2.51 \times 10^{-3}$ equivalents/g and the ring opening ratio was about 70%. 1 g of the resulting polymer was dissolved in 100 ml of the dispersion of gelatin in methanol as used in Example 2 and 1.2 g of the epoxy compound represented by Epoxy Compound (3) was added to this solution to prepare an undercoating solution. On the other hand, a biaxially elongated high impact polystyrene support containing 8% by weight of titanium dioxide was subjected to a corona discharge treatment under the same conditions as those of Example 1, coated with the same undercoating solution as described above followed by drying, and then coated with the same black-and-white silver halide photographic emulsion as that of Example 2. The adhesive strength between the support and the photographic layer was Grade A in both the dry state and the wet state.

For comparison, a similar test was carried out on the same photographic material but using an undercoating solution which did not contain an epoxy compound. The adhesive strength was Grade C in both the dry state and the wet state.

Example 6 below exemplifies preparing a photographic material in which an epoxy compound is in the emulsion layer, while Example 7 exemplifies preparing a photographic material in which a copolymer of an epoxy compound is contained in an undercoating layer.

EXAMPLE 6

An undercoating solution as in Example 1 was prepared except without adding an epoxy compound.

A biaxially stretched polystyrene support was subjected to corona discharge treatment under the same condition as in Example 1 and was then coated with the above described undercoating solution at a coating rate of 5 m/min by a conventional immersion coating technique, followed by drying at 80° C. The thus obtained undercoated support was coated with a black-and-white gelatin-silver halide photographic emulsion having the following composition per 1 $m^2$ of the support and dried:

| | |
|---|---|
| Silver Chlorobromide | 3.5 g |
| Gelatin | 13.0 g |
| Epoxy Compound (3) | 20.0 g |
| Water | 150 g |
| Saponin | 0.03g |

The adhesive strength between the emulsion layer and the support in the resulting photographic material was Grade A in all cases for the dry film both before and after development, and was Grade A for a wet film during development.

EXAMPLE 7

4 g of gelatin was swollen by 10 g of water, and then 1.4 g of salicyclic acid and 500 ml of methanol were added with agitation into the swollen gelatin to prepare a gelatin dispersion in methanol.

To 100 ml of the dispersion thus obtained 3.8 ml of 20% by weight of the copolymer solution described in Example 1 was added, and then 10 g of a 10% by weight solution of acrylic acid-glycidyl acrylate copolymer (molar ratio 7:3: softening point 80° C) in dioxane-tetrahydrofuran (1:1 by weight) was added thereto to yield an undercoating solution.

A biaxially stretched high impact polystyrene support was subjected to corona discharge treatment under the same conditions as in Example 1 and then coated with the above-described undercoating solution at a coating rate of 5 m/min by a conventional immersion coating technique, followed by drying at 90° C for 10 minutes.

The thus obtained undercoated support was coated with a gelatino-silver halide color photographic emulsion having the same composition as in Example 1.

The adhesive strength between the emulsion layer and the support in the resulting photographic material was Grade A in all cases for the dry film before and after development, and was Grade A for the wet film during development.

While the invention has been described in detail and with reference to specific embodiments thereof, it will be apparent to one skilled in the art that various changes and modifications can be made therein without departing from the spirit and scope thereof.

What is claimed is:

1. A method for manufacturing a photographic material which comprises coating a subbing composition in layer form on a styrene-based polymer support, said composition consisting essentially of 5g or less per $m^2$ of said support of a complete or partial reaction product of: materials consisting essentially of (a) a copolymer of styrene or vinyl acetate with maleic anhydride which contains 40–50% by weight of maleic anhydride with (b) water or a hydroxy compound represented by the general formula $R_1$—OH wherein $R_1$ is a monovalent hydrocarbon group having 1 to 12 carbon atoms or monovalent organic group having 2–12 carbon atoms and consisting of at least two hydrocarbon fragments and at least one ether linkage between said hydrocarbon fragments, at least 30% of the maleic anhydride units of said copolymer being reacted with the water or the hydroxy compound thereby obtaining a reaction product consisting essentially of the following recurring units:

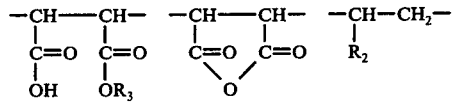

in which $R_3$ is a hydrogen atom or a group defined by $R_1$, $R_2$ is a phenyl group or a —$OCOCH_3$ group and the amount of the maleic anhydride unit in said copolymer may be zero, and coating a hydrophilic photographic composition containing a hydrophilic resin binder in layer form on the subbing layer, where the resulting hydrophilic photographic composition layer is selected from the group consisting of (1) a layer containing silver halide, (2) a layer containing physical developing nuclei to serve as a receiving layer in diffusion transfer photography, a hydrophilic photographic curl preventing backing layer or a hydrophilic photographic anti-halation backing layer, where a compound containing at least two epoxy groups per molecule is contained in a proportion of from 10 to 500% by weight based on the weight of said copolymer in at least one of the subbing composition or the hydrophilic photographic composition.

2. The method of claim 1 in which said compound containing two or more epoxy groups per molecule is in the subbing composition.

3. The method of claim 1 in which said compound containing two or more epoxy groups per molecule is in the hydrophilic photographic composition.

4. The method of claim 1 in which said compound containing epoxy groups has a molecular weight less than about 20,000.

5. The method of claim 1 in whichsaid compound containing epoxy groups has a molecular weight less that 1,000.

6. The method of claim 1 wherein said compound containing two or more epoxy groups is selected from the group consisting of:

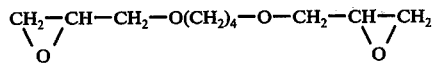

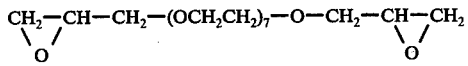

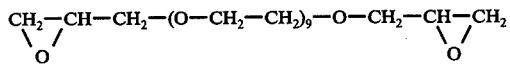

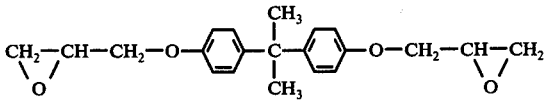

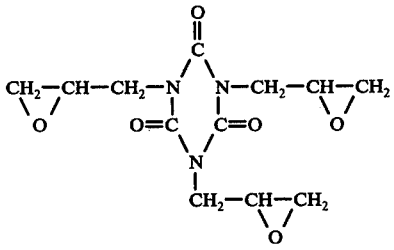

7. The method of claim 1 wherein said subbing composition additionally contains gelatin.

8. The method of claim 1 wherein said complete or partial reaction product of said copolymer has a molecular weight ranging from about 8,000 to about 1,000,000.

9. The method of claim 1 wherein $R_1$ is an alkyl group, a phenyl group, a phenylalkyl group, an alkoxyalkyl group, an alkoxyalkoxyalkyl group, o5r a phenoxyalkyl group.

10. The method of claim 1 wherein said hydroxy compound is an alcohol and said $R_1$ is selected from the group consisting of methyl, ethyl, propyl, butyl and lauryl.

11. The method of claim 1 wherein said subbing composition is coated on said support after a surface pretreatment of said support.

12. The method of claim 11 wherein said surface pretreatment is by a corona discharge treatment, an ozone oxidation treatment, an ultraviolet irradiation treatment, a flame treatment, an electroless discharge treatment, or a low pressure electric discharge treatment.

13. The method of claim 1, wherein hydrophilic hydrophilic composition is in the form of an emulsion or dispersion.

14. The method of claim 1, wherein said hydrophic photographic composition if in the form of a solution.

15. The method of claim 1, wherein said hydrophilic composition contains silver halide.

16. The method of claim 1, wherein said hydrophilic composition contains physical development nuclei.

17. The method of claim 1, wherein said hydrophilic resin binder in said hydrophilic photographic composition comprises gelatin.

18. The method of claim 1, wherein said hydrophilic resin binder in said hydrophilic photographic composition consists of gelatin.

19. The method of claim 1, wherein said copolymer consists of a copolymer of styrene and maleic anhydride.

20. The method of claim 1, wherein said copolymer consists of a copolymer of vinyl acetate and maleic anhydride.

* * * * *